US009021655B2

(12) United States Patent
Owen et al.

(10) Patent No.: US 9,021,655 B2
(45) Date of Patent: May 5, 2015

(54) VACUUM CLEANING APPLIANCE

(75) Inventors: Charles Gareth Owen, Malmesbury (GB); Spencer James Robert Arthey, Malmesbury (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 75 days.

(21) Appl. No.: 13/172,287

(22) Filed: Jun. 29, 2011

(65) Prior Publication Data

US 2012/0011680 A1 Jan. 19, 2012

(30) Foreign Application Priority Data

Jul. 16, 2010 (GB) ..... 1011995.6

(51) Int. Cl.
*A47L 5/26* (2006.01)
*A47L 9/04* (2006.01)

(52) U.S. Cl.
CPC *A47L 9/04* (2013.01); *A47L 9/0477* (2013.01)

(58) Field of Classification Search
USPC ..... 15/383, 384, 389, 415.1, 416, 418–420
See application file for complete search history.

(56) References Cited

U.S. PATENT DOCUMENTS

| | | | | |
|---|---|---|---|---|
| 5,018,240 | A | 5/1991 | Holman | |
| 5,513,418 | A * | 5/1996 | Weber | 15/383 |
| 7,281,297 | B2 * | 10/2007 | Peacock et al. | 15/384 |
| 7,434,294 | B2 * | 10/2008 | Naito et al. | 15/418 |
| 7,441,307 | B2 * | 10/2008 | Smith | 15/387 |

FOREIGN PATENT DOCUMENTS

| | | |
|---|---|---|
| CN | 101039616 | 9/2007 |
| EP | 2 033 559 | 3/2009 |
| GB | 2 347 847 | 9/2000 |
| GB | 2 393 383 | 3/2004 |
| GB | 2415609 | 1/2006 |
| GB | 2469729 | 10/2010 |
| JP | 9-10143 | 1/1997 |
| JP | 2003-325393 | 11/2003 |

(Continued)

OTHER PUBLICATIONS

International Search Report and Written Opinion mailed Aug. 29, 2011, directed to International Application No. PCT/GB2011/051128; 14 pages.

(Continued)

*Primary Examiner* — Dung Van Nguyen
(74) *Attorney, Agent, or Firm* — Morrison & Foerster LLP

(57) ABSTRACT

A cleaner head is described for use with a vacuum cleaning appliance including a fan unit for generating an air flow which passes from the cleaner head to the fan unit. The cleaner head includes a rotatable agitator assembly including an agitator for sweeping dust particles. The agitator assembly is housed in an agitator chamber housing including a downwardly-directed opening through which dust particles energized by the agitator enter the cleaner head, and a dust outlet located adjacent the opening and through which the energized particles leave the agitator chamber. The cleaner head also includes an exhaust port from which a dust-bearing air flow is drawn from the cleaner head, and a dust channel extending between the dust outlet and the exhaust port. The dust channel has channel walls which are shaped to retain energized dust particles therebetween through collisions thereagainst.

23 Claims, 16 Drawing Sheets

(56) References Cited

FOREIGN PATENT DOCUMENTS

| | | |
|---|---|---|
| JP | 2004-57365 | 2/2004 |
| JP | 2004-65915 | 3/2004 |
| WO | WO-2004/041053 | 5/2004 |
| WO | WO-2008/070968 | 6/2008 |
| WO | WO-2009/066050 | 5/2009 |

OTHER PUBLICATIONS

GB Search Report dated Nov. 15, 2010, directed towards counterpart application No. GB1011995.6; 1 page.
GB Search Report dated Mar. 18, 2011, directed towards counterpart application No. GB 1011995.6; 1 page.

* cited by examiner

E - E

F - F

G - G

H - H

J - J

L - L

VACUUM CLEANING APPLIANCE

REFERENCE TO RELATED APPLICATIONS

This application claims the priority of United Kingdom Application No. 1011995.6, dated Jul. 16, 2010, the entire contents of which are incorporated herein by reference.

FIELD OF THE INVENTION

The present invention relates to a vacuum cleaning appliance, and to a cleaner head for a vacuum cleaning appliance.

BACKGROUND OF THE INVENTION

A vacuum cleaner typically comprises a main body containing dirt and dust separating apparatus, a cleaner head connected to the main body and having a suction opening, and a motor-driven fan unit for drawing dirt-bearing air through the suction opening and the cleaner head, and into the main body. The suction opening is directed downwardly to face the floor surface to be cleaned. The dirt-bearing air is conveyed to the separating apparatus so that dirt and dust can be separated from the air before the air is expelled to the atmosphere. The separating apparatus can take the form of a filter, a filter bag or, as is known, a cyclonic arrangement.

Vacuum cleaners generally include cylinder, or canister, cleaners, upright cleaners and hand-held cleaners. A cylinder vacuum cleaner includes a main body supported by a set of wheels which is dragged along a floor surface by a hose and wand assembly extending between the main body and the cleaner head. The cleaner head is generally releasably attached to the end of the wand which is remote from the main body. An upright vacuum cleaner typically comprises a main body, a rolling assembly mounted on the main body for maneuvering the vacuum cleaner over a floor surface to be cleaned, and a cleaner head mounted on the main body. In use, a user reclines the main body of the upright vacuum cleaner towards the floor surface, and then sequentially pushes and pulls a handle which is attached to the main body to maneuver the vacuum cleaner over the floor surface.

A driven agitator, usually in the form of a brush bar, is rotatably mounted within a cylindrical brush bar chamber of the cleaner head. The brush bar comprises an elongate cylindrical core bearing bristles which extend radially outward from the core. The suction opening is located at the bottom of the brush bar chamber, and the brush bar is mounted within the chamber so as to protrude by a small extent through the suction opening.

An exhaust port of the brush bar chamber is generally located towards the rear of the brush bar chamber. The exhaust port is usually in the form of a circular or rectangular aperture formed in the brush bar chamber. The exact location of the aperture may be determined by various factors, such as the rotational direction of the brush bar, the position of the motor or turbine relative to the cleaner head, and the space which is available behind and/or above the brush bar chamber for accommodating a duct for conveying a debris-bearing air flow away from the brush bar chamber. Particularly for upright vacuum cleaners, such as the Dyson DC24 vacuum cleaner, the desire to provide a compact vacuum cleaner for a user means that the cleaner head is located as close as possible to the main body, which generally results in the duct extending from an exhaust port located in an upper rear portion of the brush bar chamber and over a motor housing of the cleaner head to the main body.

The brush bar is activated mainly when the vacuum cleaner is used to clean carpeted surfaces. Rotation of the brush bar may be driven by an electric motor powered by a power supply derived from the main body of the cleaner, or by a turbine driven by an air flow passing through or into the cleaner head. The rotation of the brush bar causes the bristles to sweep along the surface of the carpet to be cleaned, agitating both the fibers of the carpet and any debris, such as dust particles, located on the surface of the carpet and/or between fibers of the carpet, and resulting in a significant amount of energy being imparted to these dust particles. With the brush bar rotating in such a direction that the bristles move from the front edge of the suction opening towards the rear edge, the majority of the energized dust particles are swept rearwardly through the suction opening and into the brush bar chamber by the rotating bristles.

The trajectory at which the energized dust particles enter the brush bar chamber depends on a number of factors, such as the rotational speed of the brush bar, the stiffness of the bristles and the penetration of the bristles within the fibers of the carpet, but our studies have shown that the energized dust particles tend to enter the brush bar chamber tangentially to the brush bar and at an acute angle of up to 45° to the plane of the suction opening. As a result, and particularly where the exhaust port is located above the rotational axis of the brush bar, the vast majority of the energized dust particles entering the cleaner head will not be swept directly through the exhaust port. Instead, the energized dust particles perform multiple collisions with the walls of the brush bar chamber, and with the bristles and core of the rotating brush bar. The random nature of these collisions can result in some of the energized dust particles being re-deposited on or within the fibers of the carpet. The other energized dust particles remain within the brush bar chamber until the energy of those energized dust particles has reduced, through the aforementioned collisions, to a level which allows the dust particles to become entrained within the air flow passing through the cleaner head from the suction opening to the exhaust port.

In order to increase the proportion of the energized dust particles which become entrained within the air flow passing through a given cleaner head, the flow rate of the air flow generated by the fan unit may be increased, for example by increasing the rotational speed and/or size of the fan unit. However, this will increase undesirably the energy consumption of the motor driving the fan unit.

SUMMARY OF THE INVENTION

In a first aspect, the present invention provides a cleaner head for a vacuum cleaning appliance comprising a fan unit for generating an air flow which passes from the cleaner head to the fan unit, the cleaner head comprising a rotatable agitator assembly comprising at least one agitator for sweeping debris from a surface, an agitator chamber housing the agitator assembly, the agitator chamber comprising a downwardly-directed opening through which debris energized by said at least one agitator enters the cleaner head, and at least one dust outlet located adjacent the opening and through which the energized debris leaves the agitator chamber, and a dust channel extending between said at least one dust outlet and an exhaust port from which a debris-bearing air flow is drawn from the dust channel, the dust channel comprising means for retaining energized debris within the dust channel until the energy of the energized debris has decreased to a level which enables the energized debris to become entrained within the air flow.

The present invention thus provides a modified cleaner head having a dust channel located between a dust outlet of the agitator chamber and the exhaust port for receiving energized debris, such as dust particles, swept from a floor or other surface by the agitator assembly. With the dust outlet being located adjacent the opening through which the energized debris enters the cleaner head, a large number of energized dust particles and other debris can enter the dust channel directly, that is, prior to any collisions with the walls of the agitator chamber and/or the agitator assembly.

The dust channel comprises means for retaining energized debris within the dust channel until the energy of the energized debris has decreased to a level which enables it to become entrained within the air flow. For example, the retaining means may comprise a one-way valve or other means located within the dust channel for preventing energized debris from returning to the agitator chamber.

Alternatively, the dust channel may comprise surfaces against which an energized dust particle or other energized piece of debris collides until its energy has decreased to a level which enables it to become entrained within the air flow. These surfaces may be provided by baffles, walls or other features located within the dust channel. These features may be connected to the channel walls of the dust channel. Alternatively, these surfaces may be provided by a fibrous, cellular or foam-like object located within the dust channel. As another alternative, or additionally, these surfaces may be provided by parts of the channel walls of the dust channel. These surfaces may be shaped to retain energized dust particles or other debris therebetween, through collisions thereagainst, until their energy has decreased to a level which enables them to become entrained within the air flow. These surfaces may be curved or faceted. The retention of the energized debris within the dust channel means that there is no longer a requirement to generate a relatively high air flow to capture energized debris from within the agitator chamber before it is re-deposited on the floor surface.

We have found that, in fact, the provision of the dust channel in a cleaner head of a vacuum cleaner having a relatively small motor driving the fan unit can enable the vacuum cleaner to achieve a debris pick-up performance which is comparable to that of a vacuum cleaner having a larger motor driving the fan unit, and therefore a higher energy consumption.

The dust channel may be configured so that substantially all of the energized debris entering the dust channel is retained within the dust channel until its energy has decreased to a level which enables it to become entrained within the air flow. Alternatively, in order to decrease the residence time of at least some of the energized debris within the dust channel the dust channel may comprise means for directing energized debris colliding thereagainst towards the exhaust port. This can increase the rate at which energized debris becomes entrained within the air flow and conveyed thereby to the vacuum cleaning appliance. For example, the means for directing energized debris colliding thereagainst towards the exhaust port may comprise a baffle or a wall of the dust channel.

In a second aspect the present invention provides a cleaner head for a vacuum cleaning appliance comprising a fan unit for generating an air flow which passes from the cleaner head to the fan unit, the cleaner head comprising a rotatable agitator assembly comprising at least one agitator for sweeping debris from a surface, an agitator chamber housing the agitator assembly, the agitator chamber comprising a downwardly-directed opening through which debris energized by said at least one agitator enters the cleaner head, and at least one dust outlet located adjacent the opening and through which energized debris leaves the agitator chamber, and a dust channel extending between said at least one dust outlet and an exhaust port from which a debris-bearing air flow is drawn from the dust channel, the dust channel comprising means for directing energized debris colliding thereagainst towards the exhaust port.

While the location of the at least one dust outlet is such that it is located adjacent the opening to receive the energized debris swept from the floor surface by the agitator assembly, the location of the exhaust port from which the debris-bearing air flow is drawn from the cleaner head is not so constrained. This can allow the exhaust port to be positioned at a suitable location to allow the cleaner head to be connected to the vacuum cleaning appliance with minimal ducting and/or space therebetween.

For example, depending on the rotational direction of the agitator assembly relative to the agitator chamber, the exhaust port may be located at or towards the rear of the cleaner head. Depending on the position of an air inlet of the vacuum cleaning appliance for receiving the debris-bearing air flow from the cleaner head, the exhaust port may be located between side walls of the cleaner head, in which case the means for directing energized debris colliding thereagainst towards the exhaust port may be configured to direct energized debris colliding thereagainst inwardly towards the exhaust port. Alternatively, or additionally, the exhaust port may be located above the agitator chamber, in which case the means for directing energized debris colliding thereagainst towards the exhaust port may be configured to direct energized debris colliding thereagainst inwardly and/or upwardly towards the exhaust port.

Depending on the rotational direction of the agitator assembly, and therefore the direction in which the energized debris enters the cleaner head through the opening, the dust channel may extend rearwardly or forwardly from the cleaner head. However, in order to provide a relatively narrow cleaner head the dust channel preferably extends about an upper portion of the agitator chamber. The dust channel is preferably in the form of a funnel, having at least one relatively wide mouth for receiving energized debris and a relatively narrow outlet from which the debris leaves the dust channel entrained within the air flow. However, the dust channel may have any other shape, such as a tubular, convoluted, spiral, or serpentine shape, for preventing the energized debris from returning to the agitator chamber.

The channel walls preferably comprise an inner channel wall located proximate, and preferably extending at least partially about, the agitator assembly, and an outer channel wall extending about the inner channel wall, and which is preferably connected to the inner channel wall. The inner channel wall is preferably located between the exhaust port and the agitator chamber. The outer channel wall may provide an upper surface of the cleaner head. To provide a compact cleaner head, the inner channel wall may separate the agitator chamber from the dust channel.

The cleaner head preferably comprises means for deflecting energized debris upwardly between the channel walls. Depending on the rotational direction of the agitator assembly, the deflecting means may be located behind or in front of the agitator assembly, and arranged to deflect energized debris either behind or in front of the inner channel wall so that the energized debris moves upwardly between the channel walls of the dust channel.

The deflecting means may curve upwardly away from the opening of the cleaner head to provide one or more concave surfaces for deflecting energized debris between the channel walls. Alternatively, the deflecting means may comprise one or more inclined or faceted surfaces for deflecting energized debris between the channel walls.

The cleaner head preferably comprises a surface engaging sole plate comprising said opening, and the deflecting means is preferably connected to, or integral with, the sole plate. The deflecting means may provide a continuous surface which extends from the sole plate to the outer channel wall, and is preferably connected to the outer channel wall. Alternatively, the deflecting means may be integral with the outer channel wall and extend downwardly to connect to, or engage, the sole plate. The deflecting means may also provide a working edge for agitating the fibers of a carpeted floor surface as the cleaner head is maneuvered thereover.

At least one of the shape and the height of the outer channel wall may vary along the length thereof, for example so as to direct energized debris colliding thereagainst towards the exhaust port. In a preferred embodiment, the outer channel wall comprises a first section shaped to direct energized debris colliding thereagainst towards the inner channel wall, and a second section shaped to direct energized debris colliding thereagainst towards the exhaust port.

The first section of the outer channel wall preferably comprises a concave surface against which the energized debris collides. Thus, depending on the angle of incidence of the energized debris the debris may be deflected by the first section of the outer channel wall towards either the inner channel wall or the second section of the outer channel wall.

The inner channel wall may be shaped to direct energized debris colliding thereagainst towards either the first section or the second section of the outer channel wall. The inner channel wall preferably comprises a convex surface against which the energized debris collides. Thus, depending on the angle of incidence of the energized debris the debris may be deflected by the inner channel wall towards either the first section or the second section of the outer channel wall. The inner channel wall and the first section of the outer channel may be partially cylindrical, and may be substantially co-axial.

Thus, an energized dust particle or other debris may be (i) retained within the dust channel, through collisions with the inner channel wall and the first section of the outer channel wall, until its energy reduces to such a level that it becomes entrained within the air flow passing through the cleaner head, or (ii) guided towards the second section of the outer channel wall, through one or more of the aforementioned collisions, to impact the second section of the outer channel wall so that it is deflected towards the exhaust port.

The path of the air flow drawn through the cleaner head preferably extends through the dust channel from the dust outlet of the agitator chamber to the exhaust port. The exhaust port is preferably formed in the outer channel wall. A connector for connecting the cleaner head to a vacuum cleaning appliance may be integral with the outer channel wall.

The at least one dust outlet may be at least partially defined by an edge of the inner channel wall. The edge of the inner channel wall is preferably substantially parallel to the rotational axis of the agitator assembly so that the height of the at least one dust outlet is uniform along the length of the inner channel wall. The edge of the inner channel wall may be relatively narrow to minimize the likelihood of an energized dust particle colliding thereagainst so that it is directed away from the dust channel. Alternatively, the width of the edge of the inner channel wall may be increased to provide a surface against which energized debris can collide and be directed towards the deflecting means.

Where the at least one agitator is arranged to sweep dust particles and other debris rearwardly from the surface, depending on the desired height of the at least one dust outlet the inner channel wall may curve forwardly and upwardly from the edge thereof. The at least one dust outlet preferably extends lengthways along the agitator chamber.

The at least one dust outlet may comprise a single dust outlet which extends substantially the length of the agitator assembly, or a plurality of dust outlets spaced along the length of the agitator assembly. The cleaner head may comprise a single exhaust port, or a plurality of exhaust ports. For example, where the cleaner head comprises a plurality of dust outlets and a plurality of exhaust ports, each exhaust port may be arranged to receive dust or other debris from a respective dust outlet. In this case the cleaner head may comprise a plurality of dust channels each extending between a respective dust outlet and a respective exhaust port.

In a third aspect the present invention provides a vacuum cleaning appliance comprising a cleaner head as aforementioned, a fan unit for generating an air flow which passes from the cleaner head to the fan unit, and separating apparatus for separating debris from the air flow. The separating apparatus preferably comprises cyclonic separating apparatus.

Features described above in connection with the first aspect of the invention are equally applicable to the second and third aspects of the invention, and vice versa.

BRIEF DESCRIPTION OF THE DRAWINGS

Preferred features of the present invention will now be described, by way of example only, with reference to the accompanying drawings, in which:

FIG. 8(*b*) is a similar view to FIG. 8(*a*), but with an inner wall of the second upper body section removed;

FIG. 9(*b*) is a similar view to FIG. 9(*a*), but with an inner wall of the second upper body section removed;

FIG. 11(*b*) is a side sectional view along line F-F of FIG. 10;

FIG. 11(*c*) is a side sectional view along line G-G of FIG. 10;

FIG. 11(*d*) is a side sectional view along line H-H of FIG. 10;

FIG. 11(*e*) is a side sectional view along line J-J of FIG. 10;

FIG. 11(*f*) is a side sectional view along line L-L of FIG. 10;

DETAILED DESCRIPTION OF THE INVENTION

Figure 1:
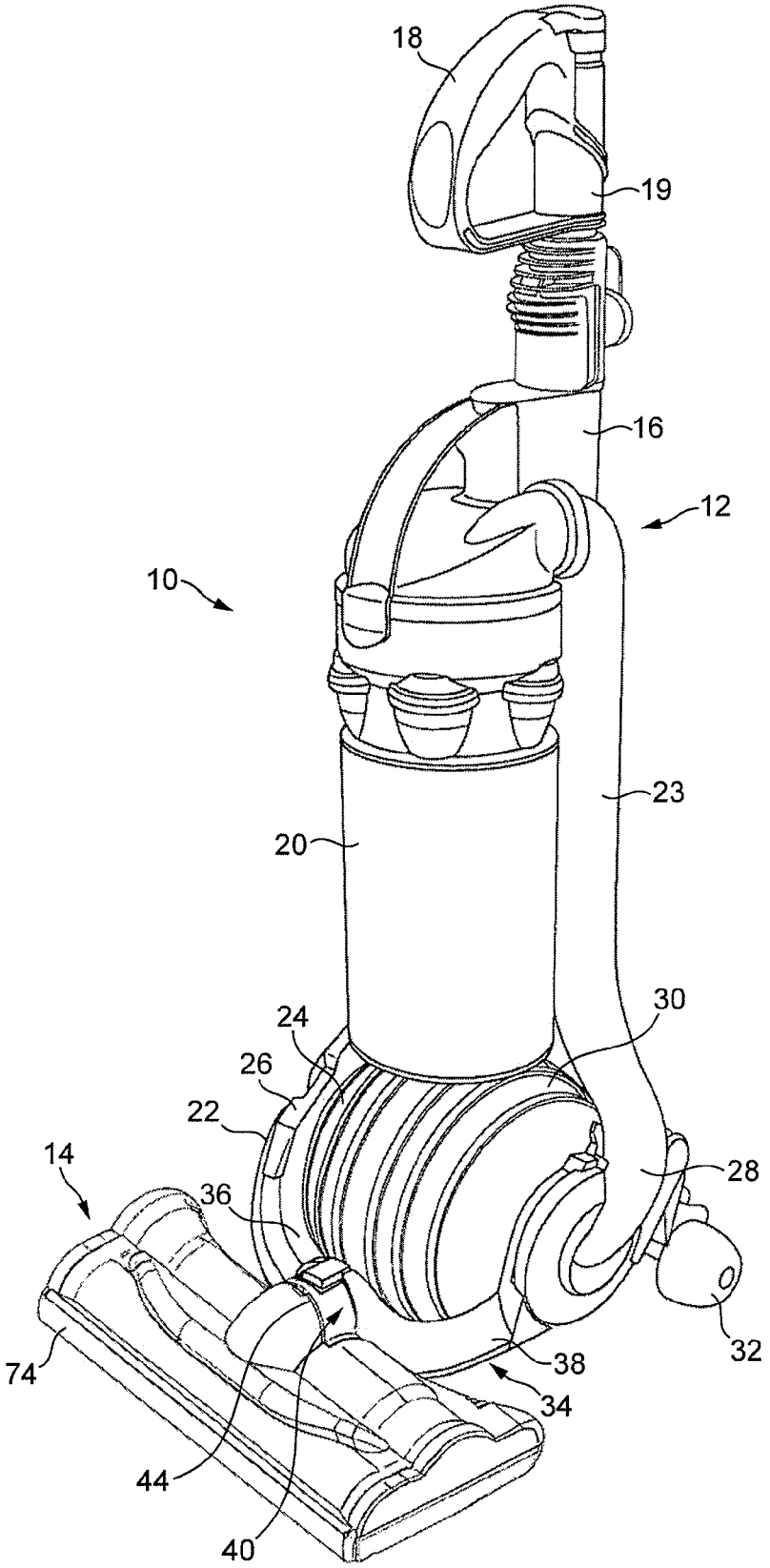
FIG. 1 is a front perspective view, from above, of a vacuum cleaning appliance.

FIG. 1 illustrates a vacuum cleaner 10. In this example the vacuum cleaner 10 is an upright vacuum cleaner, similar to the Dyson DC24 vacuum cleaner, which has a main body 12 and a cleaner head 14. The main body 12 includes a spine 16 and a handle 18 located on the end of a wand 19 which is releasably connected to the spine 16. The handle 18 can be manipulated by a user to maneuver the vacuum cleaner 10 across a floor surface.

Separating apparatus 20 is releasably attached to the spine 16. The interior of the separating apparatus 20 is in communication with the main body 12 by way of ducting 22, 23. The ducting 22 carries a dust-bearing airflow from the cleaner head 14 to the separating apparatus 20, whereas the ducting 23 conveys a relatively clean air flow away from the separating apparatus 20. In the embodiment shown, the separating apparatus 20 comprises a cyclonic separating apparatus but this could be replaced by a filter, a bag or a combination of different known separation devices. The nature of the separating apparatus 20 is not material to the present invention.

A rotatable support member 24 is located at the base of the main body 12 and supports the main body 12 on the floor surface. The support member 24 is rotatably connected to two support arms 26, 28 forming part of the main body 12. The support member 24 has an arcuate outer surface 30 when viewed in a lateral direction. The shape of the outer surface 30 allows the vacuum cleaner 10 to be maneuvered more easily across the floor surface than traditional upright vacuum cleaners having a pair of wheels.

A motor and fan unit (not shown) for drawing an air flow into the vacuum cleaner 10 is mounted inside the support member 24. The motor and fan unit is mounted so that the outer surface 30 of the support member 24 rotates around the motor and fan unit. The inlet to the motor and fan unit is formed in the support arm 28 which is in communication with the ducting 23. The support arm 28 and the ducting 23 thus define an airflow path from the separating apparatus 20 to the motor and fan unit.

In order to support the vacuum cleaner 10 when in an upright, stored position (as shown in FIG. 1), the main body 12 is provided with a stand 32. The stand 32 comprises a frame and a pair of wheels, and is shown in an extended position in FIG. 1. The stand 32 is retractable so that the vacuum cleaner 10 can be maneuvered in use. An example of a suitable stand is shown and described in EP 1 838 195.

The main body 12 further includes a yoke 34. The yoke 34 comprises two arms 36, 38 which are pivotably connected to the support arms 26, 28 on either side of the support member 24. The ducting 22 is formed in the left-hand arm 36 of the yoke 34. The arms 36, 38, support arms 26, 28 and support member 24 are all connected about a common axis X-X.

Figure 2:
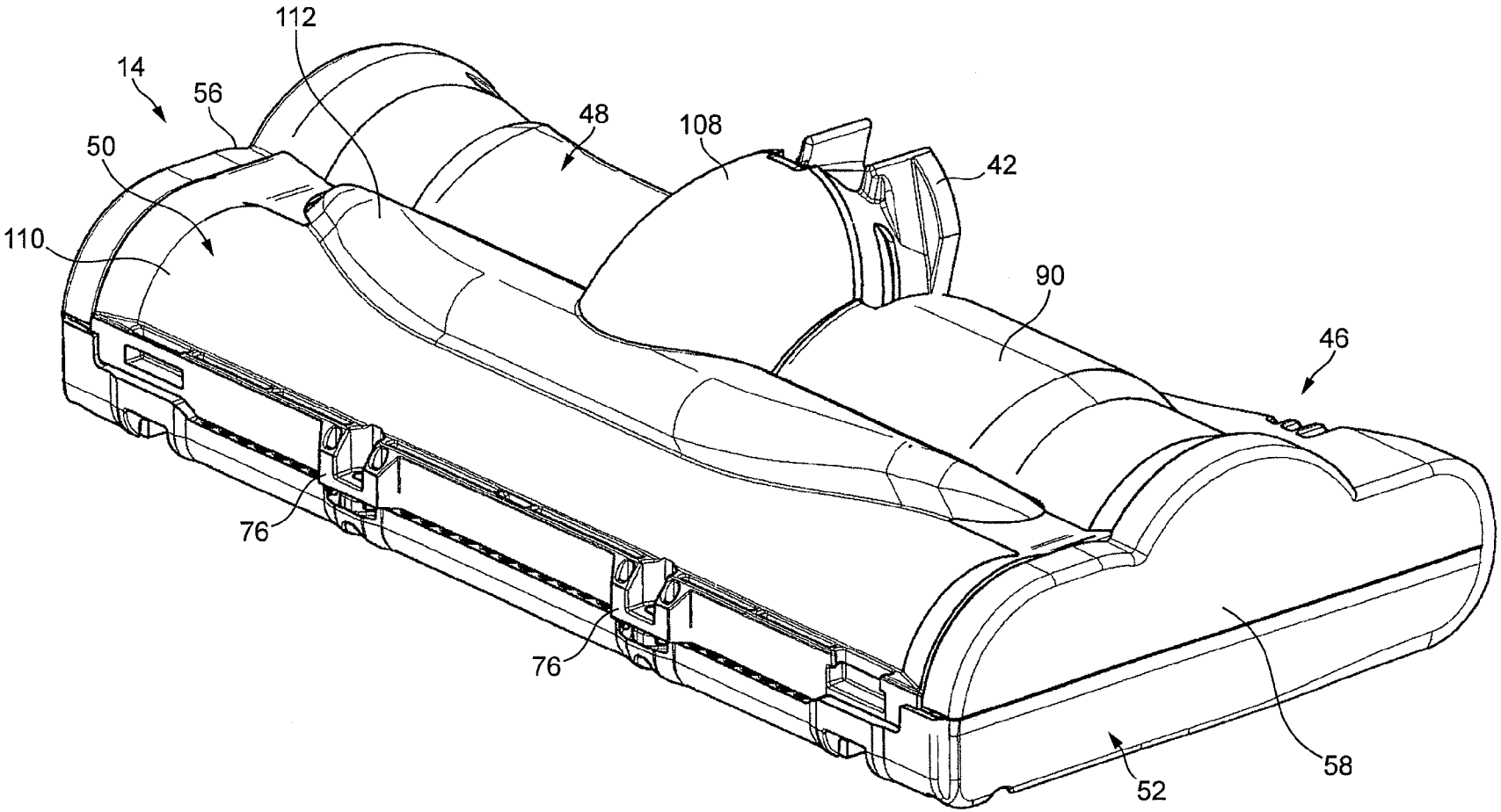
FIG. 2 is a front perspective view, from above, of the cleaner head of the appliance of FIG. 1.
Figure 3:
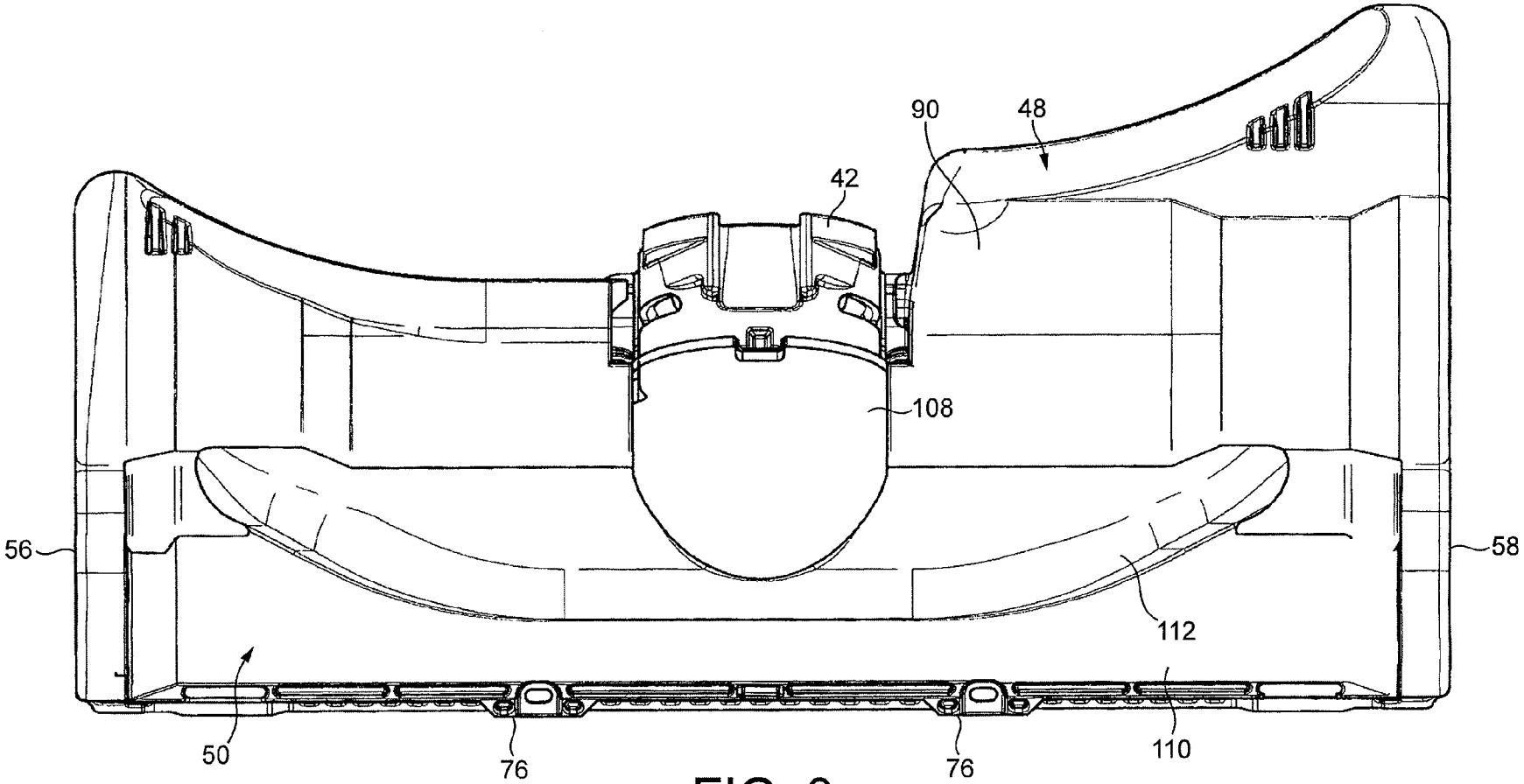
FIG. 3 is a top view of the cleaner head.

The cleaner head 14 is rotatably connected to the front of the yoke 34 by a connection assembly 40. The connection assembly 40 is described in WO 2009/066050, the contents of which are incorporated herein by reference. The connection assembly 40 comprises a first connector (not shown) located on the yoke 34, a second connector 42 (shown in FIG. 2) located on the cleaner head 14 and a removable connecting member 44. The removal of the connecting member 44 from the remainder of the connection assembly 40 enables the cleaner head 14 and the main body 12 to be separated from one another as described below.

The cleaner head 14 will now be described with reference to FIGS. 2 to 12. The cleaner head 14 comprises a main body 46 which includes a first upper body section 48, a second upper body section 50, and a lower body section, or sole plate, 52. The first upper body section 48 extends over and around part of the second upper body section 50, and is connected to the sole plate 52 by means of fasteners 54 insertable through apertures formed in the sole plate 52. The connector 42 is integral with the second upper body section 50. The first upper body section 48 and the sole plate 52 together form substantially parallel side walls 56, 58 of the main body 46.

Figure 4:
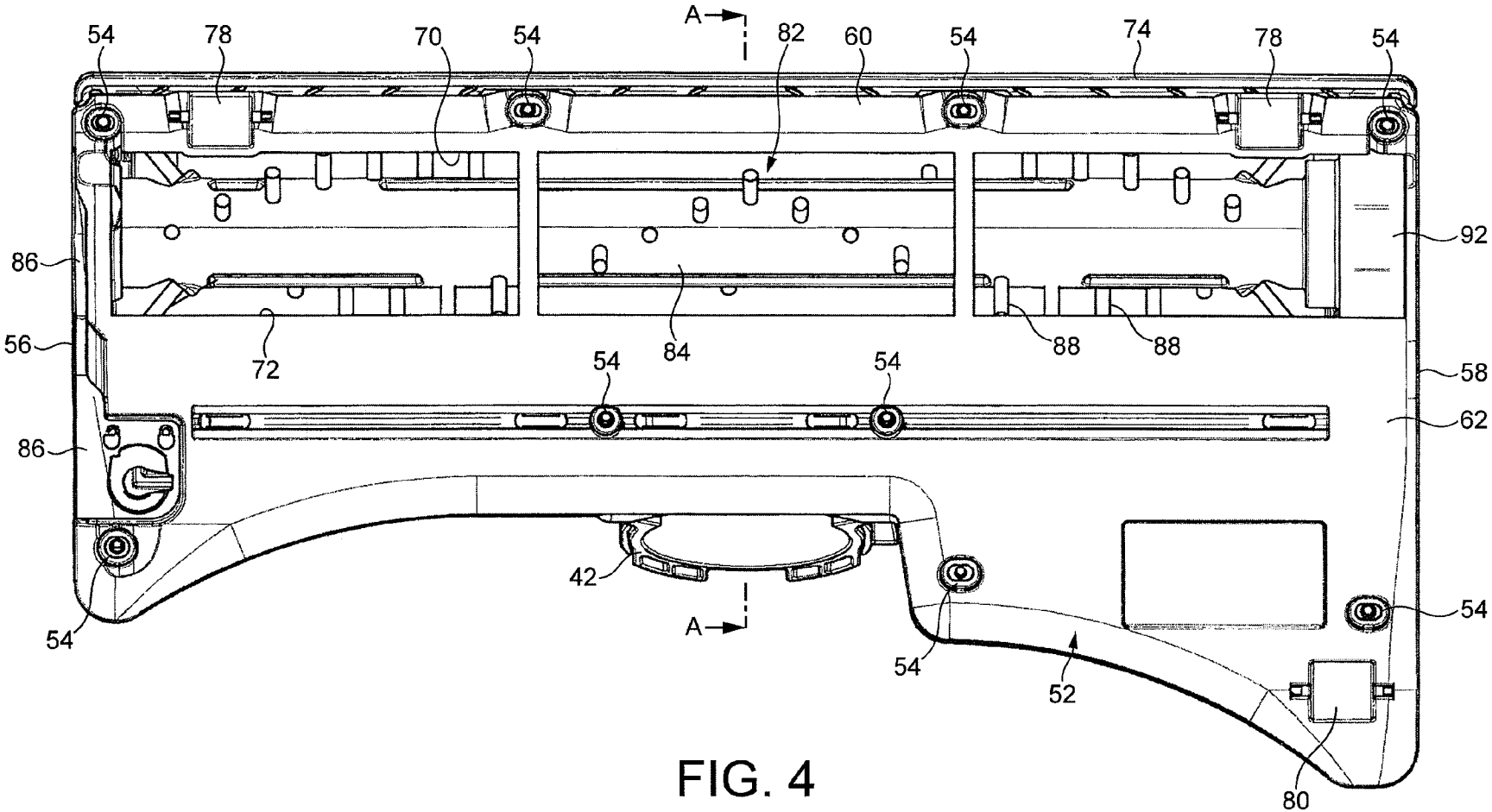
FIG. 4 is a bottom view of the cleaner head.
Figure 5:
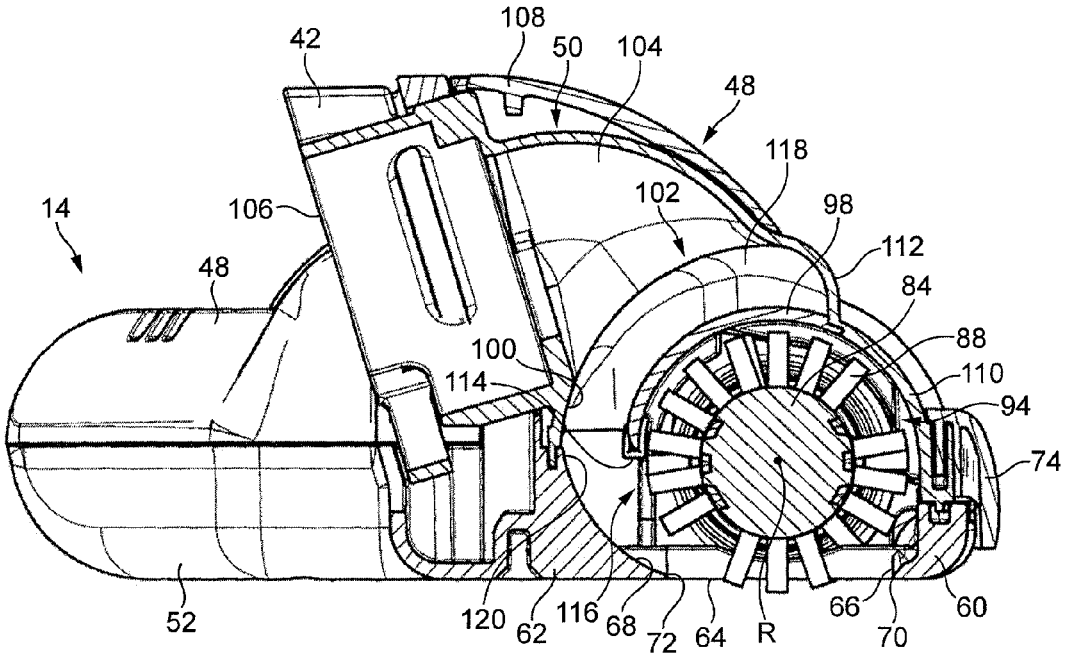
FIG. 5 is a side sectional view along line A-A of FIG. 4.

In use, the sole plate 52 faces the floor surface to be cleaned and, as described in more detail below, engages the upper surface of a carpeted floor. With particular reference to FIGS. 4 and 5, the sole plate 52 comprises a leading section 60 and a trailing section 62 located on opposite sides of a suction opening 64 through which a debris-bearing air flow is drawn into the cleaner head 14. The suction opening 64 is generally rectangular in shape, and is delimited by the side walls 56, 58, a relatively long front wall 66 and a relatively long rear wall 68 which each upstand from, and are integral with, the bottom surface of the sole plate 52.

The sole plate 52 comprises two working edges for agitating the fibers of a carpeted floor surface as the floor tool 10 is maneuvered over such a surface. A front working edge 70 of the sole plate 52 is located at the intersection between the front wall 66 and the bottom surface of the leading section 60 of the sole plate 52, and extends between the side walls 56, 58. A rear working edge 72 of the sole plate 52 is located at the intersection between the rear wall 68 and the bottom surface of the trailing section 62 of the sole plate 52, and extends between the side walls 56, 58. The working edges 70, 72 are preferably relatively sharp.

A front bumper 74 is mounted on the front of the cleaner head 14. The front bumper 74 is omitted from FIGS. 2 and 3 to illustrate bumper connectors 76 located on the front of the second upper body section 50 to which the bumper 74 is connected, for example by means of snap-fit connections.

To prevent the working edges 70, 72 from scratching or otherwise marking a hard floor surface as the vacuum cleaner 10 is maneuvered over such a surface, the cleaner head 14 comprises at least one surface engaging support member which serves to space the working edges 70, 72 from a hard floor surface. In this embodiment, the cleaner head 14 comprises a plurality of surface engaging support members which are each in the form of a rolling element, preferably a wheel. A pair of front wheels 78 is rotatably mounted within a pair of recesses formed in the leading section 60 of the sole plate 52, and a rear wheel 80 is rotatably mounted within a recess formed in the trailing section 62 of the sole plate 52. The wheels 78, 80 protrude downwardly beyond the working edges 70, 72 so that when the vacuum cleaner 10 is located on a hard floor surface with the wheels 78, 80 engaging that surface, the working edges 70, 72 are spaced from the hard floor surface.

During use, a pressure difference is generated between the air passing through the cleaner head 14 and the external environment. This pressure difference generates a force which acts downwardly on the cleaner head 14 towards the floor surface. When the vacuum cleaner 10 is located on a carpeted floor surface, the wheels 78, 80 are pushed into the fibers of the carpeted floor surface under the weight of the cleaner head 14 and the force acting downwardly on the cleaner head 14. The wheels 78, 80 will readily sink into the carpeted floor surface to bring at least the working edges 70, 72 of the sole plate 52 into contact with the fibers of the floor surface.

Figure 6:
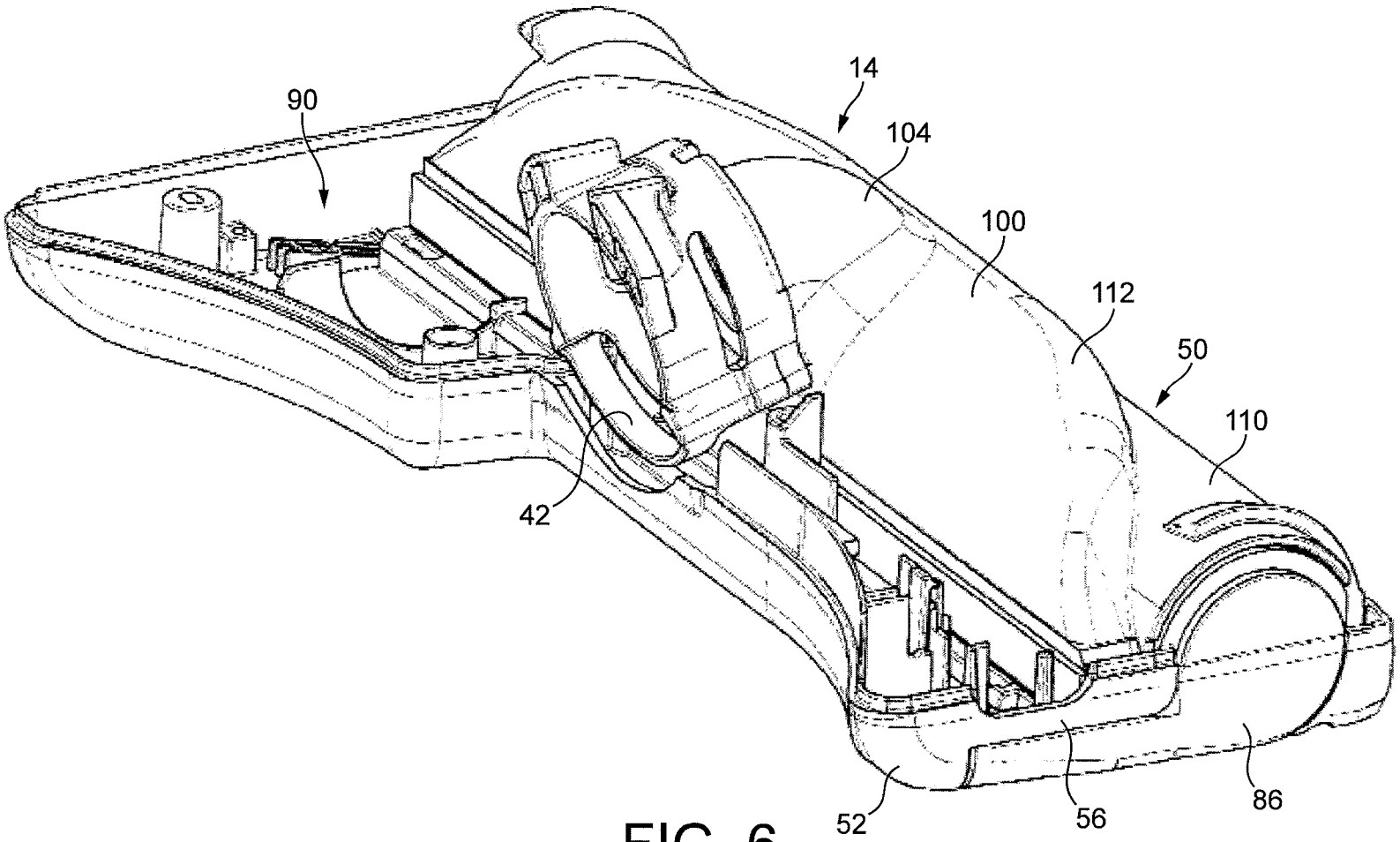
FIG. 6 is a rear perspective view, from above, of the cleaner head, with a first upper body section of the cleaner head removed.

The cleaner head 14 further comprises an agitator assembly 82 for agitating the fibers of a carpeted floor surface. In this embodiment the agitator assembly 82 is in the form of a brush bar which is rotatable relative to the main body 46 about axis R. The agitator assembly 82 comprises a generally cylindrical body 84 which rotates about the longitudinal axis thereof. One end of the body 84 is supported by a removable section 86 of the side wall 56 of the main body 46 (as shown in FIG. 6) for rotation relative to the main body 46, whereas the other end of the body 84 is supported and rotated by a drive mechanism which is described in more detail below.

The agitator assembly 82 further comprises a plurality of agitators which in this embodiment are in the form of bristles 88 protruding radially outwardly from the body 84. The agitator assembly 82 is arranged so that the bristles 88 protrude through the suction opening 64 with rotation of the agitator assembly 82 to allow the bristles 88 to sweep dirt and dust from both a hard floor surface and a carpeted surface. The bristles 88 are arranged in a plurality of clusters, which are preferably arranged at regular intervals along the body 84 in one or more helical formations. The bristles 88 are preferably formed from an electrically insulating, plastics material. Alternatively, at least some of the bristles 88 may be formed from a metallic or composite material in order to discharge any static electricity residing on a carpeted floor surface. As an alternative to, or in addition to, bristles 88, the agitator assembly 82 may comprise at least one strip of flexible material.

The agitator assembly 82 is driven by a drive motor (not shown) which has an electrical connection to the main body 12 of the vacuum cleaner 10. The drive motor is housed within a motor housing 90 located towards the rear of the cleaner head 14, between the first upper body section 48 and the sole plate 52. A drive mechanism (not shown) connects the drive motor to the agitator assembly 82. The drive mechanism is located within a drive housing 92 located to one side of the agitator assembly 82. The drive mechanism comprises a drive pulley which is connected to a drive shaft rotated by the drive motor, and a driven pulley which is connected to the drive pulley by a belt. A drive dog is mounted on one side of the driven pulley for connection to the body 84 of the agitator assembly 82. As described in WO 2009/066050, the drive motor is connected to a power supply of the vacuum cleaner 10 when the cleaner head 14 is connected to the yoke 34 of the vacuum cleaner 10.

The agitator assembly 82 is housed within an agitator chamber 94 of the cleaner head 14. The agitator chamber 94 is bounded by the second upper body section 50, the sole plate 52, and the side walls 56, 58. The suction opening 64 provides an opening through which dirt, dust particles and other debris is swept into the agitator chamber 94 by the rotating bristles 88 of the agitator assembly 82. In this example, the drive motor and drive mechanism are arranged to rotate the agitator assembly 82 in such a direction that the bristles 88 sweep dirt and dust rearwardly, that is, over the rear working edge 72, into the agitator chamber 94.

Figure 7:
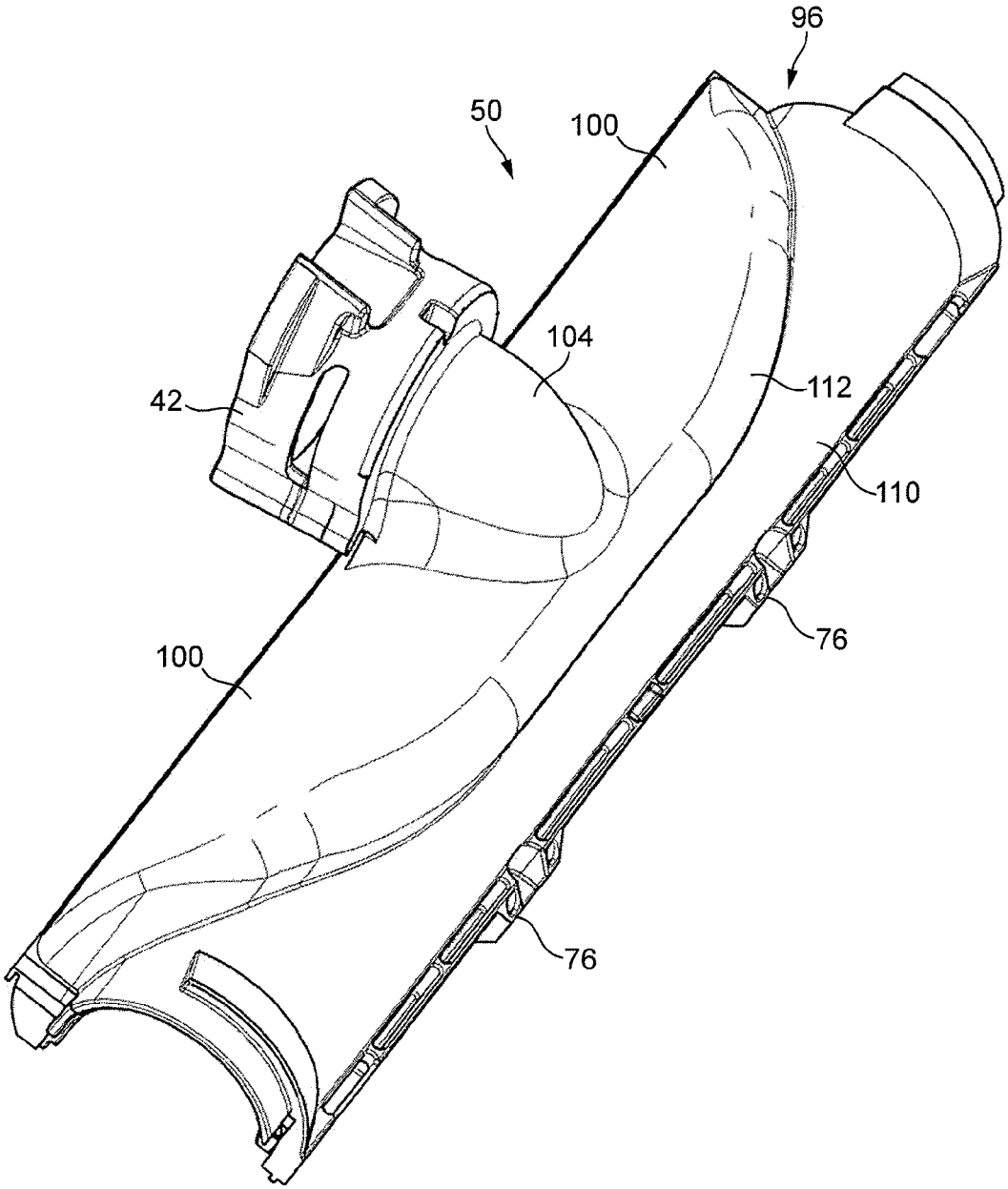
FIG. 7 is a front perspective view, from above, of a second upper body section of the cleaner head.
Figure 8A:
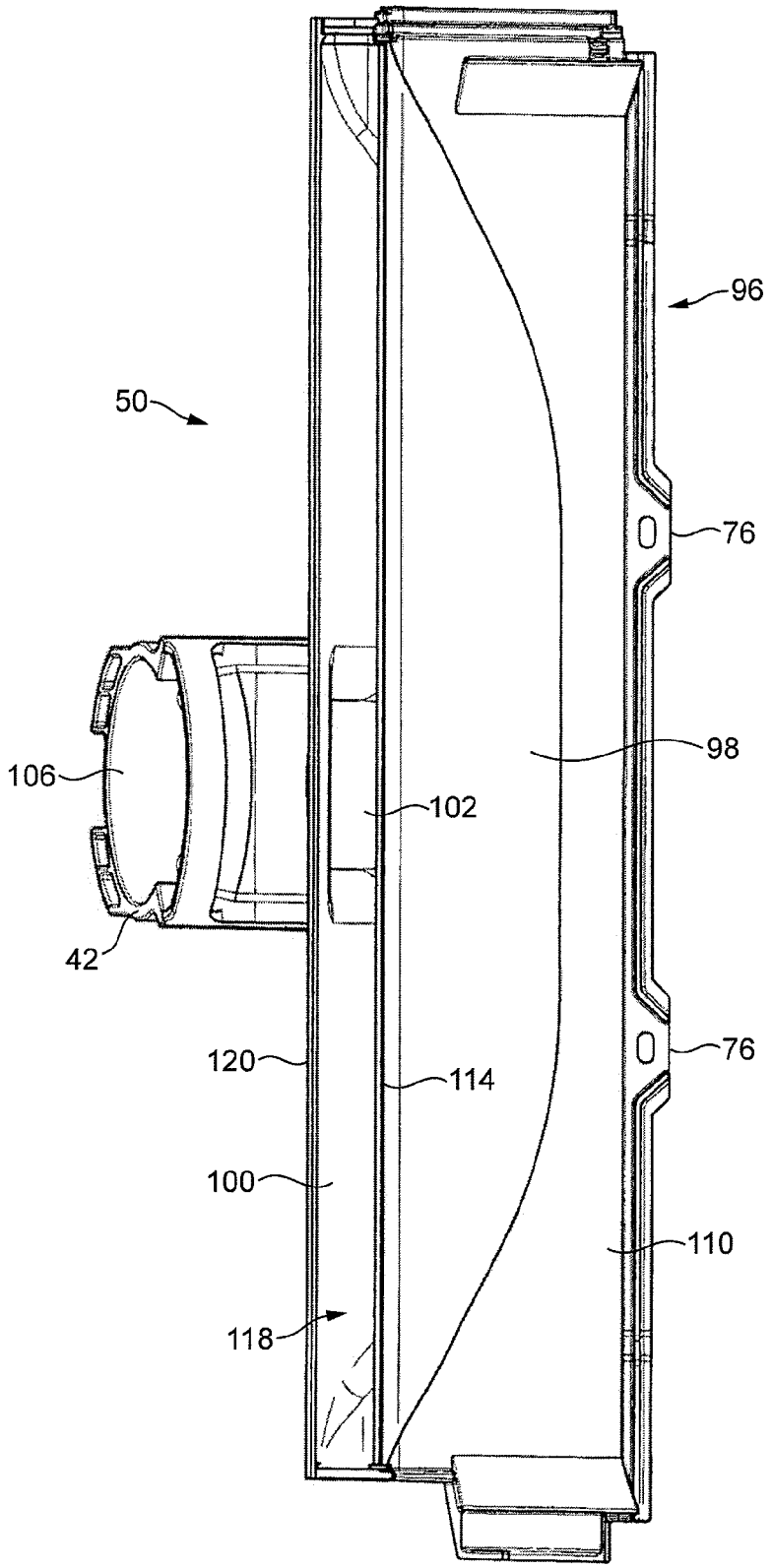
FIG. 8(*a*) is a bottom view of the second upper body section of the cleaner head.
Figure 8B:
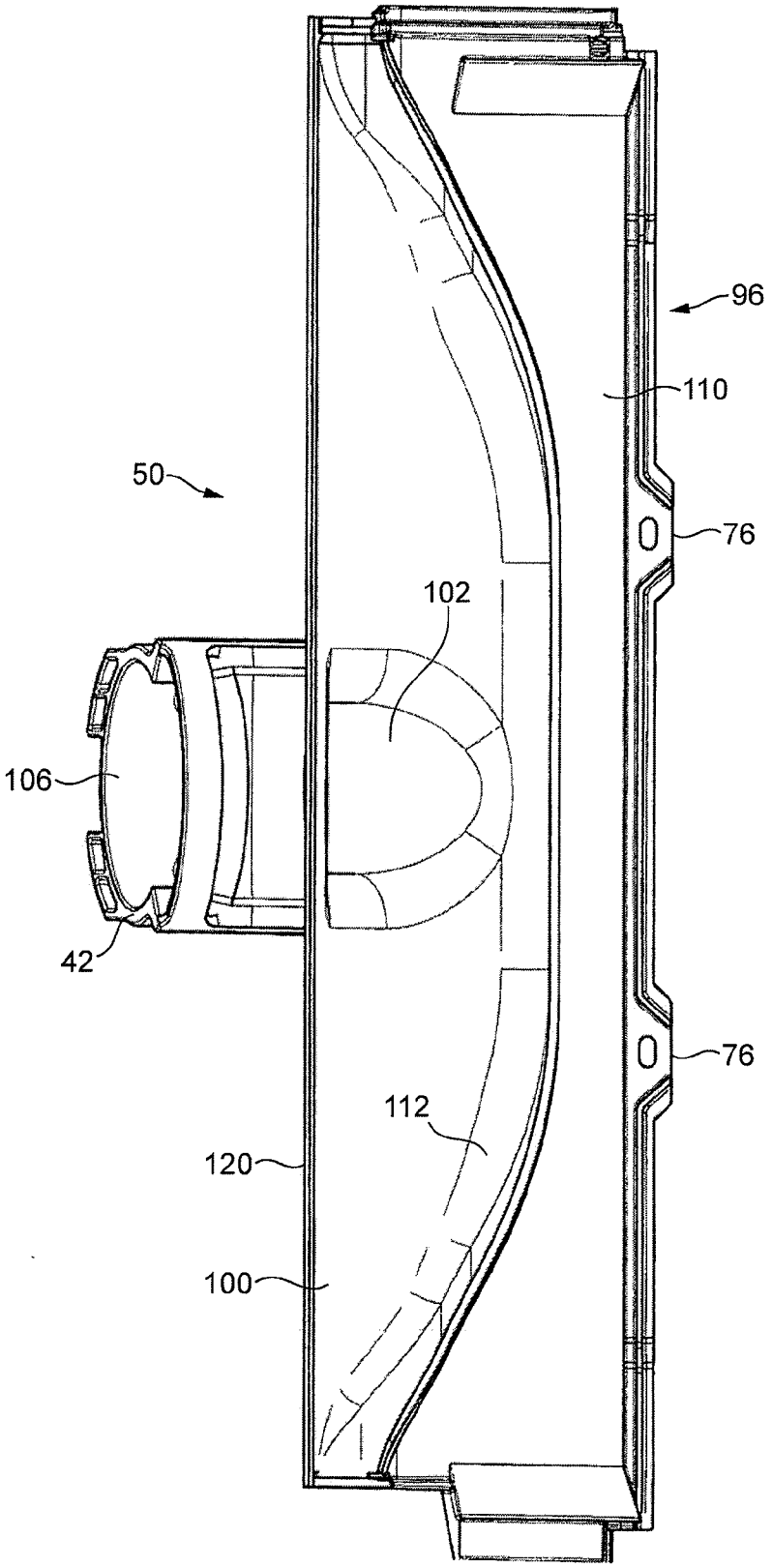
Figure 9A:
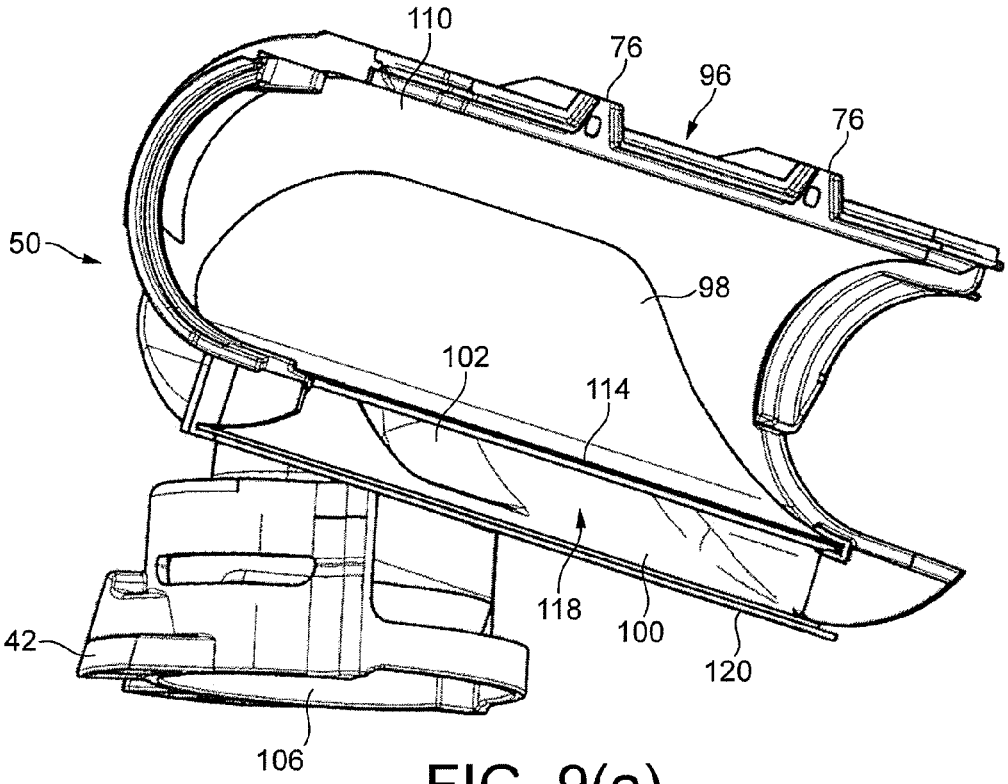
FIG. 9(*a*) is a rear perspective view, from below, of the second upper body section of the cleaner head.
Figure 9B:
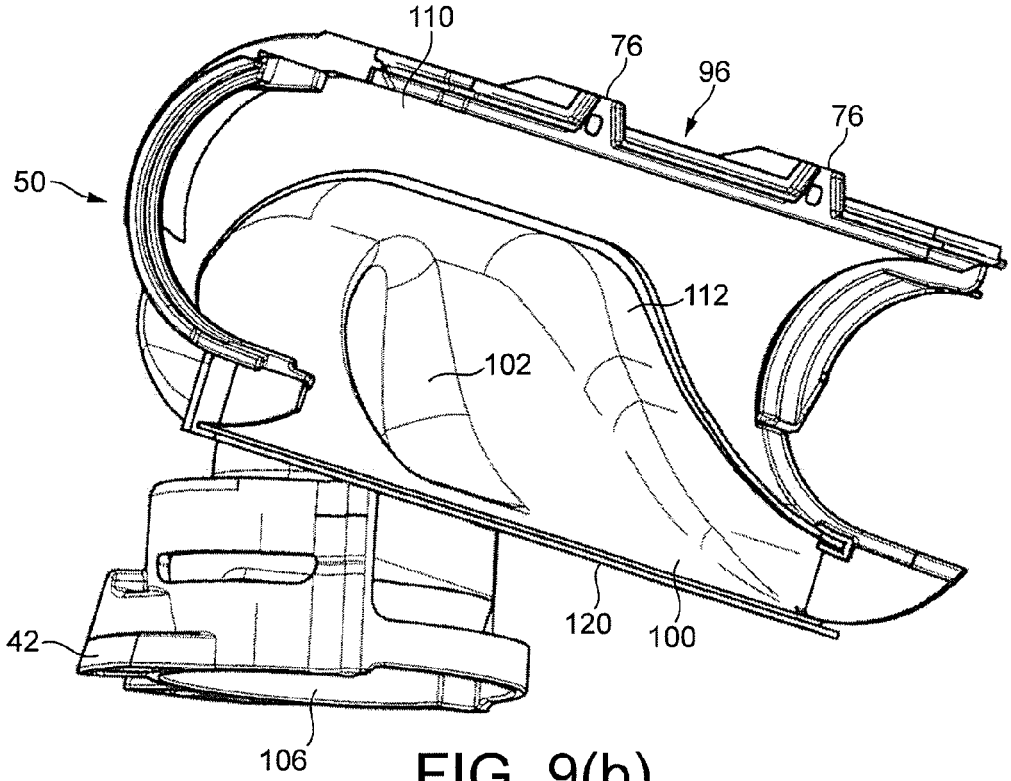

The second upper body section 50 of the cleaner head 14 is illustrated in FIGS. 7 to 9(*b*). The second upper body section 50 comprises an outer wall 96 and an inner wall 98 connected to the outer wall 96 so that the outer wall 96 extends about the inner wall 98. The outer wall 96 comprises a number of sections. A rear section 100 of the outer wall 96 is connected to and extends upwardly and forwardly from the upper end of the rear wall 68 of the sole plate 52. The rear section 100 of the outer wall 96 is shaped so that the adjoining portions of the rear wall 68 and the rear section 100 are substantially flush when the cleaner head 14 is assembled. The rear section 100 is arcuate in shape, generally in the form of an irregular section of a cylinder, and extends about the axis R of the agitator assembly 82.

As discussed in more detail below, an exhaust port 102 is formed in the rear section 100 of the outer wall 96. In this example the exhaust port 102 is located between the side walls 56, 58 of the cleaner head 14, preferably substantially midway between these side walls 56, 58. Also, in this example the exhaust port 102 is located above the agitator chamber 94. As shown most clearly in FIGS. 5, 8(*a*), 8(*b*), 9(*a*) and 9(*b*), the inner wall 98 is located between the exhaust port 102 and the agitator chamber 94. A duct 104 extends from the exhaust port 102 to an air outlet 106 located in the connector 42 for conveying a debris-bearing air flow from the exhaust port 102 to the ducting 22 of the vacuum cleaner 10. The duct 104 is preferably integral with the outer wall 96 of the second upper body section 50. A profiled section 108 of the first upper body section 48 extends over the upper surface of the duct 104.

A front section 110 of the outer wall 96 is connected to, and extends upwardly and rearwardly from, the upper end of the front wall 66 of the sole plate 52. The front section 110 of the outer wall 96 defines, in part, the agitator chamber 94 and so extends about a front, upper part of the agitator assembly 82. The front section 110 is in the form of a section of a cylinder, which is substantially co-axial with the axis R of the agitator assembly 82. The radius of curvature of the front section 110 of the outer wall 96 is smaller than the radius of curvature of the rear section 100 of the outer wall 96.

Figure 10:
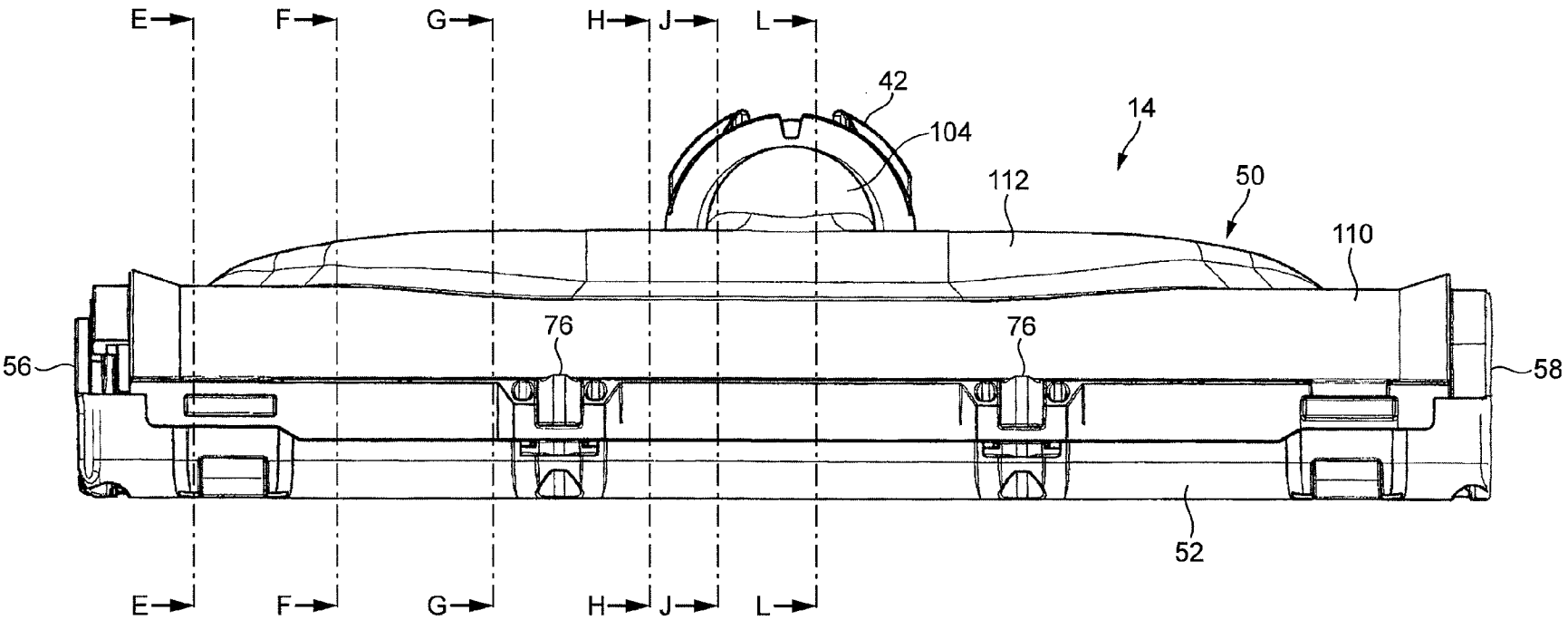
FIG. 10 is a front view of the cleaner head, with the first upper body section and the agitator assembly removed.
Figure 11A:
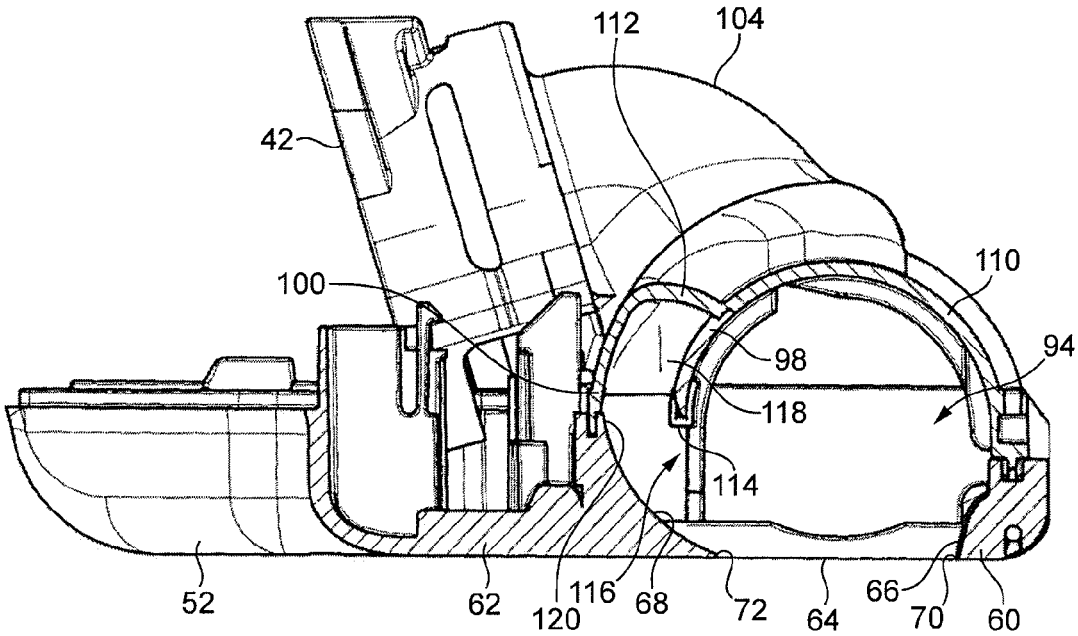
FIG. 11(*a*) is a side sectional view along line E-E of FIG. 10.
Figure 11B:
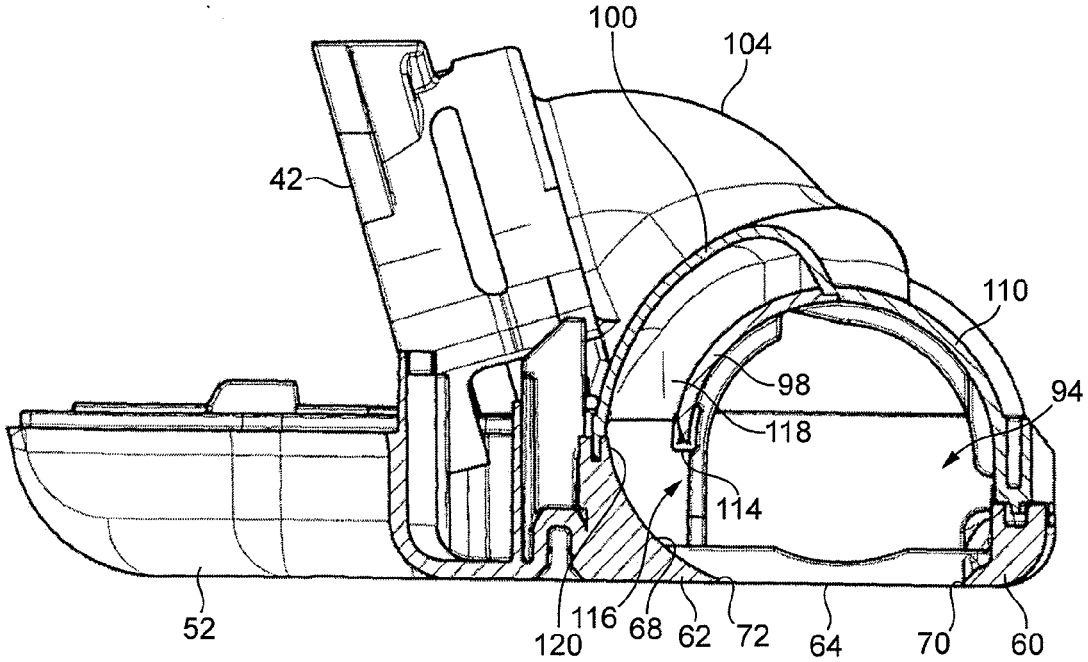
Figure 11C:
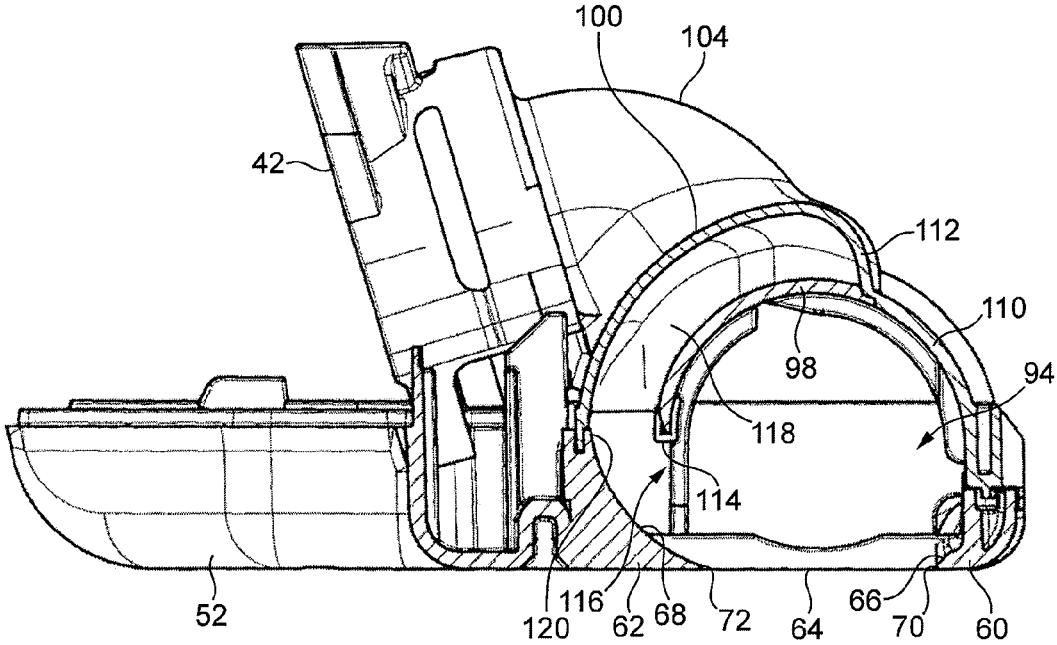
Figure 11D:
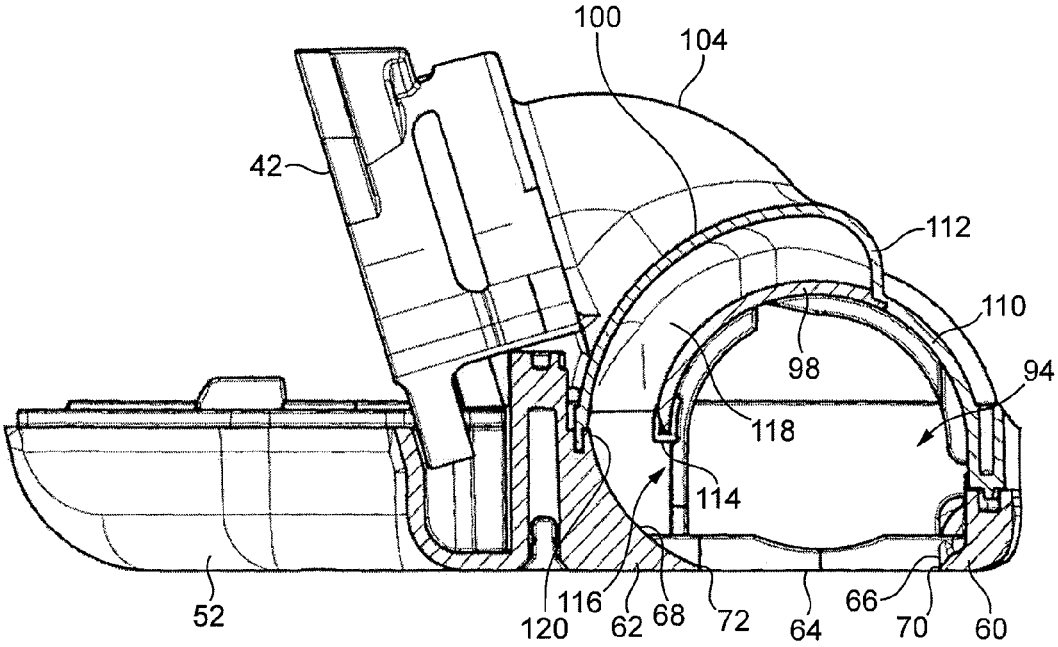
Figure 11E:
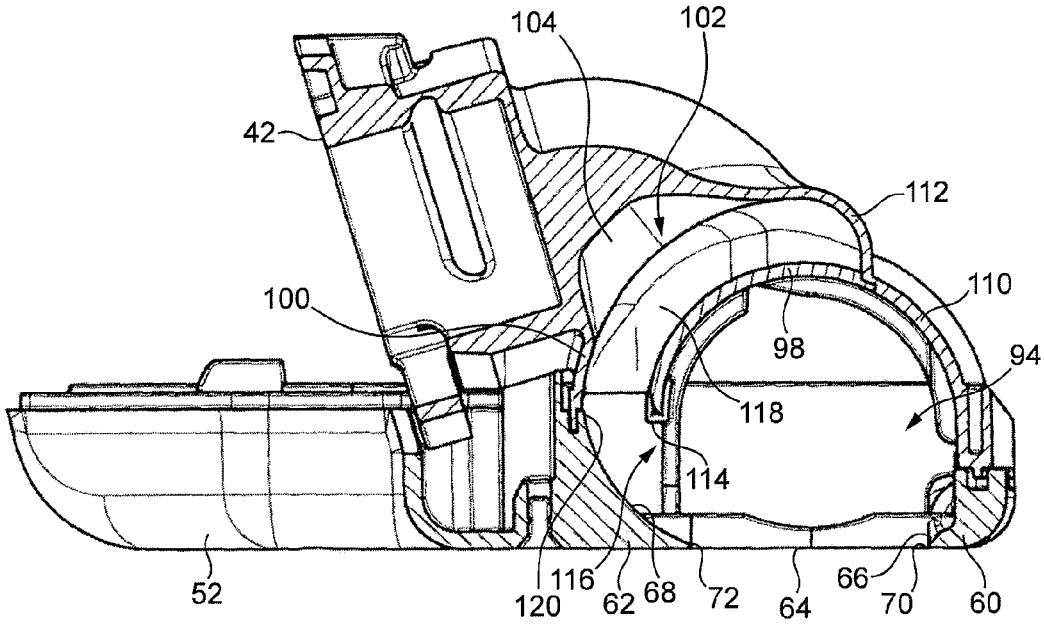
Figure 11F:
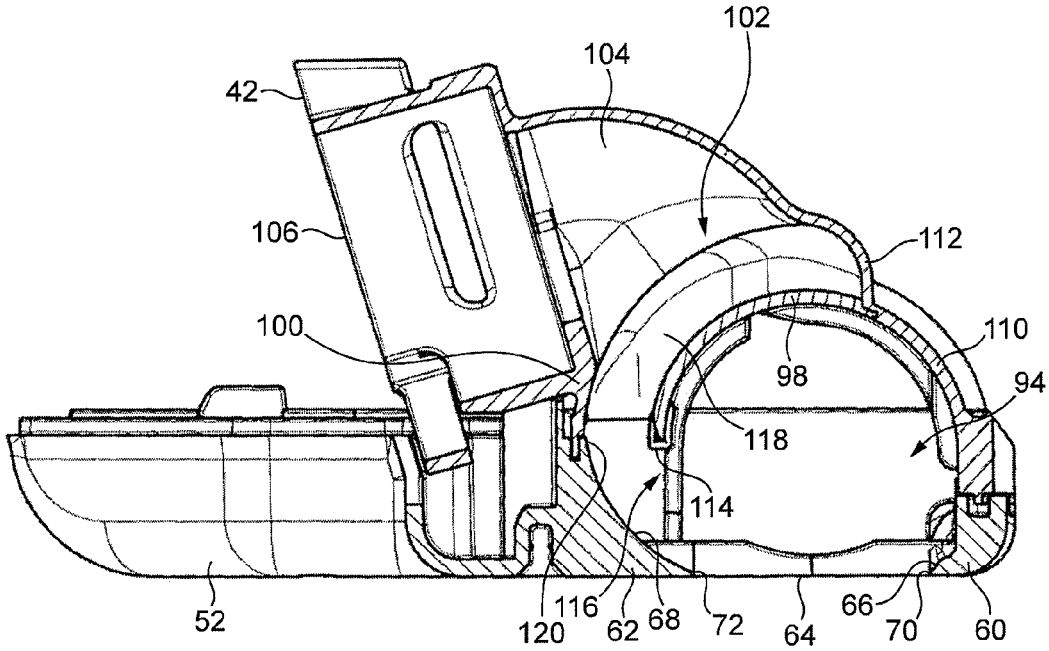

An intermediate section 112 of the outer wall 96 connects the front section 110 to the rear section 100. As shown most clearly in FIGS. 7, 8(*b*) and 9(*b*), the intermediate section 112 extends about the exhaust duct 102, and has an inner surface which is inclined towards the exhaust duct 102. Thus, and as shown in FIGS. 10 and 11(*a*) to 11(*f*), the profile of the outer wall 96 varies along the length of the cleaner head 14, that is, in a direction extending between the side walls 56, 58 of the cleaner head 14. The profile varies in a similar manner from each side wall 56, 58 to the exhaust duct 102. In general, the height of the outer wall 96, and in particular the height of the rear section 100 of the outer wall 96, varies along the length of the cleaner head 14 from a minimum value adjacent the side walls 56, 58, as shown in FIG. 11(*a*), to a maximum value midway between the side walls 56, 58.

The inner wall 98 is connected to the outer wall 96 at the intersection between the front section 110 and the intermediate section 112 of the outer wall 96. Similar to the front section 110 of the outer wall 96, the inner wall 98 defines, in part, the agitator chamber 94. The inner wall 98 is also in the form of a section of a cylinder, which is substantially co-axial with the axis R of the agitator assembly 82 and has the same radius of curvature as the front section 110 of the outer wall 96. The lower end 114 of the inner wall 98 is spaced from the sole plate 52 to define a dust outlet 116 from the agitator chamber 94. The dust outlet 116 is located between the lower end 114 of the inner wall 98 and the rear working edge 72 of the sole plate 52, and so is located adjacent the suction opening 52. In this example the lower end 114 of the inner wall 98 is generally straight, and extends substantially the entire length of the agitator chamber 94. The lower end 114 of the inner wall 98 is substantially parallel to the axis R of the agitator assembly 82, and so the height of the dust outlet 116 is substantially constant along the length of the agitator chamber 94.

A dust channel 118 is located between the outer wall 96 and the inner wall 98 of the second upper body section 50. The dust channel 118 extends between the dust outlet 116 of the agitator chamber 94 and the exhaust port 102, and thus extends over and about part of the agitator chamber 94. The dust channel 118 is generally in the shape of a curved funnel having a relatively wide mouth and a relatively narrow outlet. The dust channel 118 is bounded by the inner wall 98, and by the rear and intermediate sections 100, 112 of the outer wall 96 of the second upper body section 50, which together provide channel walls of the dust channel 118.

The dust channel 118 defines part of an air flow path which extends through the cleaner head 14, and along which air is drawn by the motor and fan unit of the vacuum cleaner 10. The air flow path extends from the suction opening 52, through the dust outlet 116 of the agitator chamber 94 and through the dust channel 118 to the exhaust port 102. The air flow path continues from the exhaust port 102 to the air outlet 106 through the duct 104. Depending on the flow rate of the air drawn through the cleaner head 14, the air flow path may extend along the shortest path between the exhaust port 102 and the dust outlet 116, which is generally over the surfaces of the rear section 100 of the outer wall 96 and the rear wall 68 of the sole plate 52.

In use, the rotating bristles 88 of the agitator assembly 82 contact, and so transfer energy to, dust particles and other debris located on a floor surface, or between the fibers of a carpeted floor surface. As the agitator assembly 82 is rotated within the agitator chamber 94 so that the bristles 88 pass from the front working edge 70 and through the suction opening 52 to the rear working edge 72, the majority of the energized debris (hereafter referred to as energized dust particles) is swept rearwardly through the suction opening 52. We have observed that energized dust particles tend to travel along paths which are generally up to 20° from a tangent to the agitator assembly 82. Due to the location of the dust outlet 116 adjacent to the suction opening 52, and in this example immediately behind the suction opening 52, these energized dust particles leave the agitator chamber 94 directly, that is without first impacting the inner wall 98 or the front section 110 of the outer wall 96. The height of the dust outlet 116, that is, the distance between the rear working edge 72 and the lower end 114 of the inner wall 96 is chosen to maximize the likelihood of energized dust particles passing through the dust outlet 116 directly. The height of the dust channel 116 may be varied depending on features such as the rotational speed of the agitator assembly 82 and the stiffness of the bristles 88. In this example, the height of the dust outlet 116 is approximately the same as the distance between the axis R of the agitator assembly 82 and the sole plate 52.

The rear wall 68 of the sole plate 52 is shaped to form a deflector for deflecting energized dust particles between the outer wall 96 and the inner wall 98 of the second upper body section 50. The rear wall 68 preferably has a concave surface which faces the dust outlet 116 and extends upwardly and rearwardly from the rear working edge 72 of the sole plate 52 to the lower edge 120 of the rear section 100 of the outer wall 96. The curvature of this concave surface is selected so that the rear wall 68 deflects substantially all of the energized dust particles colliding thereagainst between the lower edges 114, 120 of the outer and inner walls 96, 98 and into the dust channel 118.

Upon entering the dust channel 118, the energy of the energized dust particles is generally too high for the dust particles to become immediately entrained within the air flow passing through the dust channel 118. In view of this, the dust channel 118 is arranged to prevent the energized dust particles located within the dust channel 118 from re-entering the agitator chamber 94. In this example the channel walls of the dust channel 118, that is, the inner wall 98 and the rear and intermediate sections 100, 112 of the outer wall 96, are shaped 94 to retain the energized dust particles within the dust channel 118, through one or more collisions with the channel walls, until the energy of the dust particles has dissipated sufficiently, through the impact with the channel walls, to enable the dust particles to become entrained within the air flow.

Figure 12:
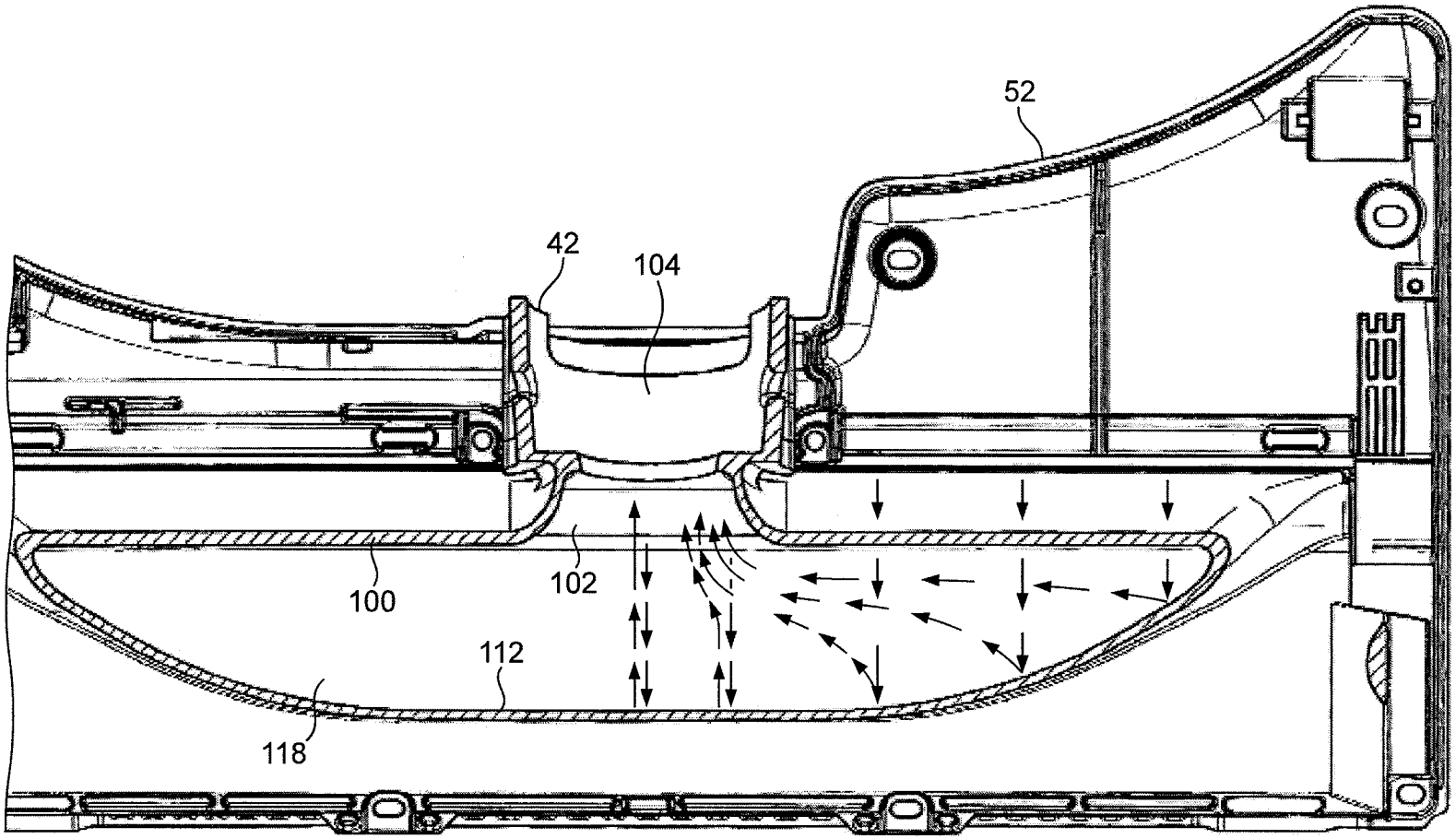
FIG. 12 is a top sectional view of the cleaner head, with the agitator assembly removed.

Upon entering the dust channel 116, the energized dust particles will tend to impact first the rear section 100 of the outer wall 96. This rear section 100 of the outer wall 96 provides a concave surface against which the energized dust particles collide. Thus, depending on the angle of incidence of the energized dust particles the dust particles will be deflected towards either the inner wall 98 or the intermediate section 112 of the outer wall 96. The inner wall 98 provides a convex surface against which the energized dust particles collide. Depending on the angle of incidence of the energized dust particles the dust particles may be deflected by the inner channel wall either back towards the rear section 100 of the outer wall 96 or, as illustrated in FIG. 12, towards the intermediate section 112 of the outer wall 96. As mentioned above, the intermediate section 112 extends about the exhaust duct 102. The intermediate section 112 has an inner surface which is inclined so as to deflect energized dust particles thereagainst towards the exhaust duct 102.

Thus, an energized dust particle may be (i) retained within the dust channel 118, through collisions against the inner wall 98 and the rear section 100 of the outer wall 96, until its energy reduces to such a level that it becomes entrained within the air flow passing through the dust channel 118 towards the exhaust port 102, or (ii) guided towards the intermediate section 112 of the outer wall 96, through one or more collisions against the inner wall 98 and/or the rear section 100 of the outer wall 96, to impact the intermediate section 112 so that it is deflected towards the exhaust port 102 to become entrained within the air flow.

Figure 13:
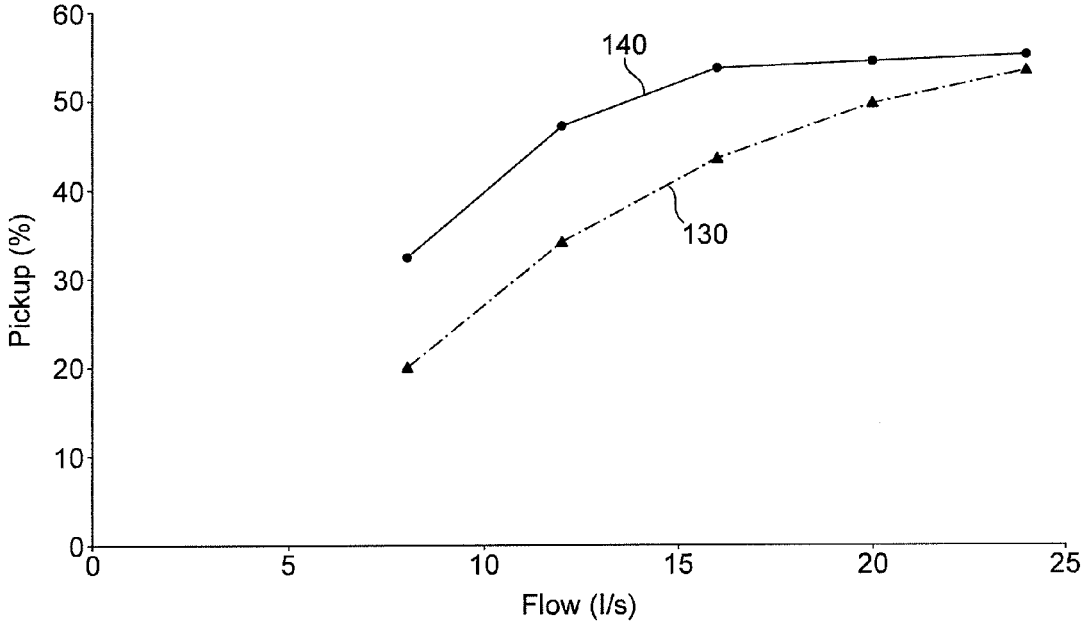
FIG. 13 is a graph illustrating the variation of dust pick up performance with the flow rate of air passing through the cleaner head.

The benefit of providing this dust channel 118 is illustrated in FIG. 13. FIG. 13 is a graph illustrating the variation of the pick up performance (measured as a percentage of an amount of dust deposited on a carpeted floor surface) with the air flow rate passing through the cleaner head of a vacuum cleaner. The amount of dust captured by the vacuum cleaner was measured after the vacuum cleaner had been moved over the floor surface five times.

Line 130 of FIG. 13 illustrates the variation of the pick up performance with air flow rate which was recorded for the conventional cleaner head of a Dyson DC24 upright vacuum cleaner, whereas line 140 illustrates the same variation which was recorded with the cleaner head 14. The size of the suction opening 64, the agitator assembly 82, and the rotational speed and direction of the agitator assembly 82 were approximately the same as those of the conventional cleaner head. As illustrated, at a relatively high flow rate of around 24 l/s, the difference in the pick up performance of the two cleaner heads was only relatively small. This is because the flow rate was high enough to entrain dust particles located within the agitator chamber of the conventional cleaner head before they are re-deposited on the floor surface due to collisions against the walls of the agitator chamber. However, as the air flow rate was decreased from 24 l/s the pick up performance of the conventional cleaner head decreased steadily, as the fewer dust were able to become entrained within the weaker air flow before being re-deposited on the floor surface. In contrast, the pick up performance of the cleaner head 14 remained relatively high as the flow rate was decreased to around 16 l/s. This is because the retention of dust particles within the dust channel 118 prevented those dust particles from being re-deposited on the floor surface before they became entrained within the air flow.

Thus, the replacement of the conventional cleaner head with the cleaner head 14 allowed a relatively high pick up performance to be achieved with a reduced air flow rate through the cleaner head, and thus with a lower energy consumption of the fan unit of the vacuum cleaner.

The invention claimed is:

1. A cleaner head for a vacuum cleaning appliance, the cleaner head comprising:

a rotatable agitator assembly comprising at least one agitator for sweeping debris from a surface;

an agitator chamber housing the agitator assembly, the agitator chamber comprising a downwardly-directed opening through which debris energized by said at least one agitator enters the cleaner head, and at least one dust outlet located adjacent the opening and through which the energized debris leaves the agitator chamber;

a dust channel extending between said at least one dust outlet and an exhaust port from which a debris-bearing air flow is drawn from the dust channel, the dust channel retaining energized debris until the energy of the energized debris has decreased to a level which enables the energized debris to become entrained within the air flow, the dust channel comprising an inner channel wall located proximate the agitator assembly, and an outer channel wall; and a deflecting member for deflecting energized debris upwardly between the channel walls, the deflecting member curving upwardly away from the opening of the cleaner head.

2. The cleaner head of claim 1 wherein the deflecting member arranged to deflect energized debris behind the inner channel wall.

3. The cleaner head of claim 1, wherein the dust channel comprises surfaces against which the energized debris collide until the energy of the energized debris has decreased to a level which enables the energized debris to become entrained within the air flow.

4. The cleaner head of claim 1, wherein the dust channel comprises channel walls having surfaces shaped to retain energized debris therebetween, through collisions thereagainst, until the energy of the energized debris has decreased to a level which enables the energized debris to become entrained within the air flow.

5. The cleaner head of claim 1, wherein the exhaust port is located above said at least one dust outlet.

6. The cleaner head of claim 1, wherein the exhaust port is located between side walls of the cleaner head.

7. The cleaner head of claim 1, wherein the exhaust port is located at or towards the rear of the cleaner head.

8. The cleaner head of claim 1, wherein the exhaust port is located above the agitator chamber.

9. The cleaner head of claim 1, wherein the dust channel extends about an upper portion of the agitator chamber.

10. The cleaner head of claim 1, wherein the dust channel extends about a rear portion of the agitator chamber.

11. The cleaner head of claim 1, comprising a surface engaging sole plate comprising said opening, and wherein the deflecting member is connected to, or integral with, the sole plate.

12. The cleaner head of claim 1, wherein the deflecting member is connected to the outer channel wall.

13. The cleaner head of claim 1, wherein the inner channel wall is connected to the outer channel wall.

14. The cleaner head of claim 1, wherein the exhaust port is formed in the outer channel wall.

15. The cleaner head of claim 1, wherein the outer channel wall provides an upper surface of the cleaner head.

16. The cleaner head of claim 1, wherein the inner channel wall separates the agitator chamber from the dust channel.

17. The cleaner head of claim 1, wherein said at least one dust outlet is at least partially defined by an edge of the inner channel wall.

18. The cleaner head of claim 17, wherein the edge of the inner channel wall is substantially parallel to the rotational axis of the agitator assembly.

19. The cleaner head of claim 17, wherein the at least one agitator is arranged to sweep debris rearwardly from the surface, and wherein the inner channel wall curves forwardly and upwardly from the edge thereof.

20. The cleaner head of claim 1, comprising a connector integral with the outer channel wall for connecting the cleaner head to a vacuum cleaning appliance.

21. The cleaner head of claim 1, wherein said at least one dust outlet extends lengthways along the agitator chamber.

22. The cleaner head of claim 1, wherein said at least one dust outlet extends along the length of the agitator assembly.

23. The cleaner head of claim 1, wherein the outer channel wall extends about the inner channel wall.

* * * * *